US005096370A

United States Patent [19]

Mohr

[11] Patent Number: 5,096,370

[45] Date of Patent: Mar. 17, 1992

[54] DEVICE FOR THE TRANSFER OF A PART STACK OF MATERIAL IN SHEET FORM FROM A GENERAL STACK TO A FURTHER-PROCESSING STATION

[76] Inventor: Wolfgang Mohr, Hundshager Weg 42, D-6238, Hofheim/Taunus, Fed. Rep. of Germany

[21] Appl. No.: 592,211

[22] Filed: Oct. 3, 1990

[30] Foreign Application Priority Data

Oct. 7, 1989 [DE] Fed. Rep. of Germany ..... 3933626

[51] Int. Cl.[5] ..... B65G 57/03

[52] U.S. Cl. ..... 414/789.1; 414/796; 414/795.5; 271/161

[58] Field of Search ..... 414/788.8, 788.9, 789.1, 414/795.5, 796, 796.2, 796.8; 271/105, 146, 161, 241, 158, 209

[56] References Cited

U.S. PATENT DOCUMENTS

| | | | |
|---|---|---|---|
| 3,211,449 | 10/1965 | Wellhouse | 271/158 X |
| 3,371,803 | 3/1968 | Hosch et al. | 414/788.9 X |
| 3,516,653 | 6/1970 | Bland | 414/793.4 X |
| 3,522,943 | 8/1970 | Swanson | 414/789.1 X |
| 3,647,045 | 3/1972 | Wegener | 414/789.1 Z |
| 3,720,407 | 3/1973 | Woodward | 271/161 |
| 3,908,836 | 9/1975 | Ikeda | 414/796 X |
| 4,349,186 | 9/1982 | Nakamura | 271/161 X |
| 4,545,715 | 10/1985 | Seefeldt | 414/789.1 |
| 4,678,175 | 7/1987 | Arldt et al. | 271/161 X |
| 4,725,180 | 2/1988 | Kasamatsu et al. | 414/788.9 X |

FOREIGN PATENT DOCUMENTS

| | | | |
|---|---|---|---|
| 123210 | 9/1901 | Fed. Rep. of Germany . | |
| 576716 | 5/1933 | Fed. Rep. of Germany . | |
| 2639677 | 1/1986 | Fed. Rep. of Germany . | |
| 3641434 | 6/1988 | Fed. Rep. of Germany | 414/796 |
| 949751 | 2/1964 | United Kingdom | 414/796 |

*Primary Examiner*—David A. Bucci
*Assistant Examiner*—Craig Slavin
*Attorney, Agent, or Firm*—Howard M. Ellis; Michael L. Dunn

[57] ABSTRACT

The invention relates to a device for the transfer of a part stack (5) of material in sheet form from a general stack (2) to a further-processing station, in particular a vibrating station (3). The device has a table (15) which is mounted in a movable chassis (13) and which is provided at least in the area of one end with a table part (21) which can be folded up out of the horizontal table plane. A pressure element (40), which can be lowered onto that area of the part stack assigned to the table part, is mounted in the chassis above the table part, the table, in a first end position for the take-over of the part stack, being moved into the stack between the part stack and the remaining stack and, in a second end position, is positioned above the further-processing station. A device of such design makes it possible, with constructionally simple formation and at the same time adjacent arrangement of general stack and further-processing station, to transfer the part stack from the general stack, to break up the part stack by means of actuation of the folding part in interaction with the pressure element, and subsequent to this the putting down of the broken up part stack on the further-processing station takes place.

12 Claims, 10 Drawing Sheets

Figure 1:
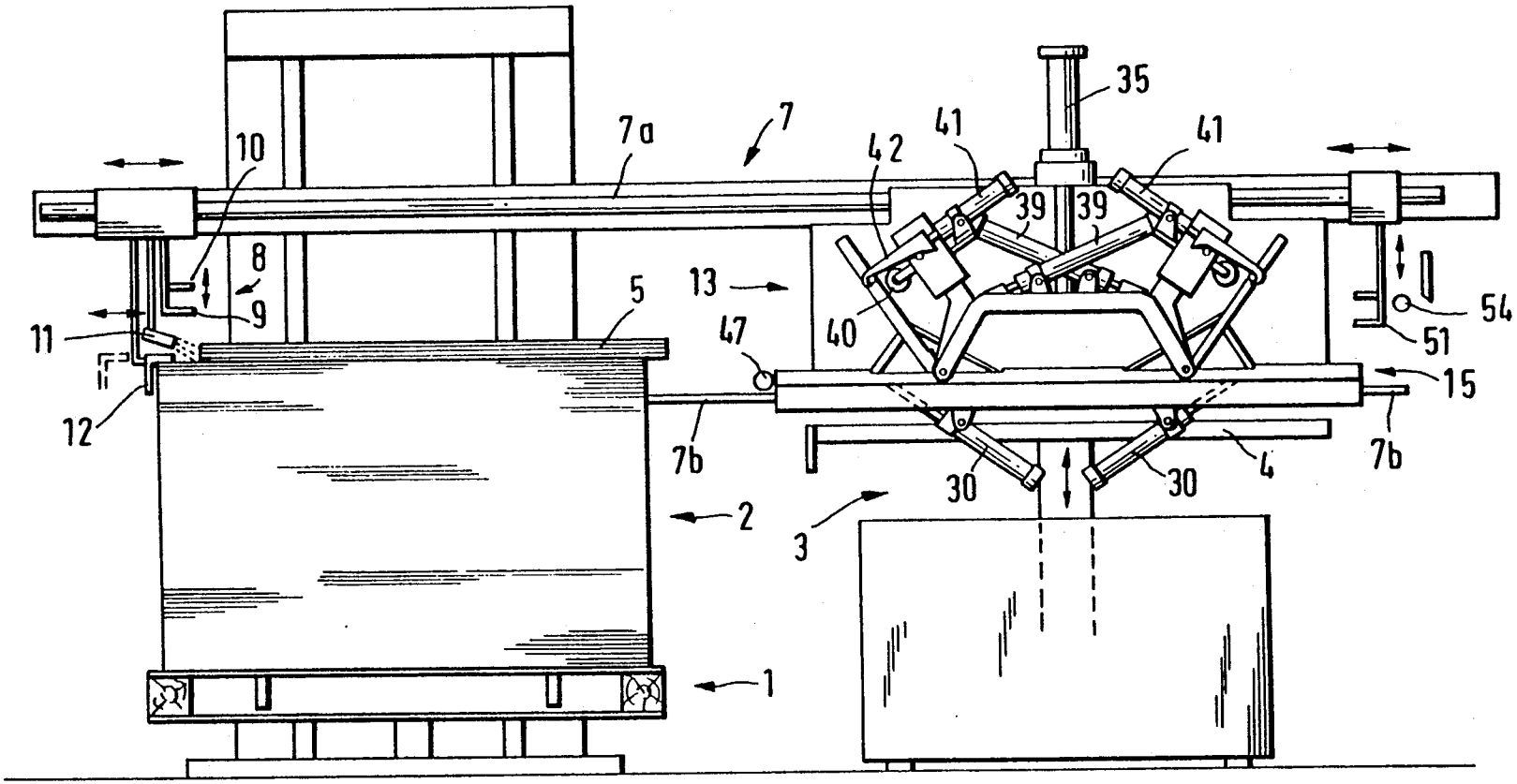

DEVICE FOR THE TRANSFER OF A PART STACK OF MATERIAL IN SHEET FORM FROM A GENERAL STACK TO A FURTHER-PROCESSING STATION

The invention relates to a device for the transfer of a part stack of material in sheet form from a general stack to a further-processing station, in particular a vibrating station, with an apparatus for the transfer of the part stack to an apparatus for the breaking up of the part stack as well as an apparatus for the transfer of the broken up part stack to the further-processing station. The term "breaking up" is in this connection to be understood as the separating of the individual sheet plies which adhere to one another as a result of, for example, atmospheric pressure, electrostatic charging, adhesion as a result of paint application etc.

From DE-OS 27 23 162, it is known to remove a part stack from a general stack and move it to a vibrating station by means of grippers. During the transport to the vibrating station, the part stack is at the same time broken up. This is a prerequisite for the individual sheet plies being capable of being displaced relative to one another in the vibrating station, as a result of which accurate alignment of the individual sheet plies at the edges becomes possible. The breaking up of the part stack is carried out by means of a pivoting movement towards one another of the grippers holding the part stack on the outside, whereupon the sheet stack is deformed from a plane shape into an arched shape, which leads to the relative movement of the individual sheet plies. The transfer and breaking up of the material in sheet form by means of a gripper arrangement gives rise to high constructional outlay in relation to the gripper arrangement, in particular because of the exact synchronization of the movement of the grippers. Apart from this, high gripper forces have to be exerted on the part stack for the secure gripping of the latter and the danger thus exists that the sheet plies of the stack are damaged. It is to be taken into consideration in this connection that the stack can have a considerable weight, which is to be seen in direct association with the gripper forces to be applied. From DE-OS 26 49 959, it is known to draw by means of grippers the part stack removed from a general stack through an advance which is arranged between the general stack and the vibrating station, is of plane design at its feed end and from there continuously changes over into the delivery end which faces towards the vibrating station, is shaped in the form of a section of a circular arc and is upwardly open. In this case, it is disadvantageous that the device for the transfer of the part stack, because of the arrangement of the advance between the general stack and the vibrating station, requires an increased constructional space and, because of the described design of the advance, it is not guaranteed that the part stack is broken up in its central areas. From DE-AS 19 51 887, it is lastly known to draw the part stack by means of a gripping pliers over an upwardly arched guide support to the vibrating station. In this case also, the disadvantage is that this device requires increased constructional space and no breaking up of the part stack in its central areas takes place.

The aim of the present invention is to produce a device of the said type, which is formed constructionally simply and envisages an adjacent arrangement of general stack and further-processing station, in which connection the respective part stack can be transferred within the shortest time.

The aim is achieved in that the apparatus for the breaking up of the part stack has a table which is mounted in a movable chassis and which has at least in the area of one end a table part which can be folded up out of the horizontal table plane, and a pressure element, which can be brought into contact with that area of the part stack assigned to the table part, is mounted in the chassis above the table part, the table, in a first end position for the take-over of the part stack, being moved into the stack between the part stack and the remaining stack and, in a second end position, is positioned above the further-processing station.

In association with the features according to the invention, a particular significance attaches to the movability of the table between the two described end positions. On the one hand, the table serves as transport means for the part stack and, on the other, the table part, which can be folded up and of which there is at least one, of the table forms in interaction with the associated pressure elements the apparatus for the breaking up of the part stack. As a result of the fact that the table can, on the one hand, be completely moved into the stack between the remaining stack and the part stack and, on the other, be positioned directly above the further-processing station, the possibility exists of positioning the general stack and the further-processing station essentially adjacent to one another. The device can be formed simply constructionally, because the transfer of the part stack to the further-processing station and the breaking up of the part stack is carried out essentially by means of the table or elements assigned to the table, if no account is taken of auxiliary elements which transfer the part stack to the table or remove it from the table.

The transfer of the part stack to the apparatus for the breaking up of the part stack is carried out expediently by means of at least one take-over gripper which, after the separation of the part stack, takes hold of the latter in particular on the side which faces away from the further-processing station and displaces it slightly over the remaining stack in the direction of the further-processing station. Advantageously, the table is provided, on its side which faces towards the general stack, with a drivable conveyor roller which, after moving under the projecting part of the part stack, supports the sliding of the latter onto the table when the table is moved in between the remaining stack and the part stack. Immediately when the table has reached its end position on the side of the stack, in which it releases the further-processing station for further operational steps assigned to it, the breaking up of the part stack can take place. Essential in this connection is the interaction of the pressure element with the part stack. In this manner, a relative displacement of the individual sheet plies of the stack takes place during the folding up of the table part and thus of the edge area of the part stack, the individual sheets primarily consisting of paper, cardboard, plastic film or the like, which can be printed or unprinted. In this connection, the pressure element comes into contact, either by means of its lowering movement or the pivoting movement of the table part, with the associated area of the part stack, and, with the pressure element acting, the table part is folded back into the table plane. As a function of an action or otherwise of a lack of action on that area of the stack which faces away from the table part which can be folded up, different breaking-up processes can be achieved. It is thus in principle sufficient for the production of the breaking-up effect if only one end of the table is provided with a table part which can be folded up. After the folding up of this table part and the application of the pressure element to the part stack, the lowering of the table part, with the pressure element acting, leads to the part stack having its individual sheet plies displaced in relation to one another and, therefore, the part stack is broken up. In this connection, it is not imperatively necessary that that end of the table which faces away from the table part which can be folded up be provided with a stop for the part stack in order to prevent the part stack sliding away from the table part which can be folded up when the latter is raised. Such an arrangement will not be necessary precisely because, as a result of the sheets sticking together, the part stack is usually a block which is partially broken up only by means of raising the table part which can be folded up and, apart from this, as a result of the own weight of the part stack, no displacement takes place in general when the table part is folded up. If necessary, however, additional means can be provided, which fix the part stack in a force-locking or form-locking manner until the pressure element makes contact with the stack area which is folded up. It is considered preferable, however, if the table has, in the area of table ends lying opposite one another, two table parts which can be pivoted about pivoting axes arranged parallel to one another, and if a pressure element, which can be brought into contact with the part stack, is provided above each table part. It is thus started out from two table parts which can be folded up and which move the part stack out of the table plane in edge areas lying opposite one another, which has the advantage that breaking up of the part stack takes place in both edge areas and additionally the table parts, which are moved in opposite directions, counteract a displacement of the part stack during the folding up of the table parts. In the case of the use of two table parts there are also, in the operational sequence, different possibilities in relation to the action on the part stack by means of one pressure element assigned to the edge area of the part stack or pressure elements assigned to each edge area. It is thus envisaged, for example, only to act upon one edge area of the part stack by means of one pressure element. This leads to the previously described displacement of the individual sheet plies of the part stack which, after the folding back of the table parts, is essentially in the form of a parallelogram. There is also the possibility that the folding back of both table parts into the table plane takes place with pressure elements acting, and in particular that the folding back takes place simultaneously. Such action of the pressure elements leads to the upper sheet plies being drawn tight in a less arched curve between the pressure elements than the lower sheet plies and the sheet plies thus have an increased tendency to separate from one another. As far as the two simultaneously acting pressure elements are concerned, the forces introduced into the part stack via these assume increased significance. The pressure force of the respective pressure element acting upon the stack is thus to be calculated in such a manner that the sheet plies facing towards it can slide under it before the tearing strength of the respective sheet is reached. Advantageously, the pressure elements are designed as rotatable rollers which in particular extend over the entire narrow side of the table. The pressure elements are to be provided with brake devices, in particular with brake devices which are adjustable in relation to the braking moment. The braking moment of the rollers is to be calculated in such a manner that these roll off before the tearing limit of the sheet plies is exceeded. The introduction of the braking moments can take place, for example, by means of disk springs which are adjustable in their pretension and which act upon the rollers in the area of the bearings of the latter.

In order to optimize the breaking-up effect of the part stack, the latter is to be transferred from the plane position into a position which is as uniformly arched as possible. In order to bring this about approximately, it is envisaged that the two table parts accommodate between them a central table part and a bridge segment, which partially covers the respective pivotable table part and is pivotably mounted parallel to the pivoting axis of the pivotable table part in the latter or the central table part, is assigned to each table part.

The breaking up of the part stack on the table takes place expediently during the movement of the table to the further-processing station. After completion of the breaking-up process, in which the table parts are folded into the table plane, and after the table is positioned in its end position above the further-processing station, at least one distributing gripper takes hold of the part stack, preferably on that side of the latter which faces away from the general stack, subsequently the table is again moved between the newly separated part stack and the remaining stack in the direction of the general stack, and as soon as the table is moved out from under the part stack taken hold of by the distributing gripper, the part stack comes into contact with the further-processing station. Here, after the release of the distributing gripper, the processing step assigned to this station is then carried out and at the same time the take-over of the next part stack onto the table and the breaking up of the part stack take place.

Further features of the invention are illustrated in the description of the Figures and in the subclaims, in which connection it is remarked that all individual features and all combinations of individual features are essential to the invention.

In FIGS. 1 to 14, the invention is illustrated with an embodiment by way of example without being restricted to this embodiment.

Figure 2:
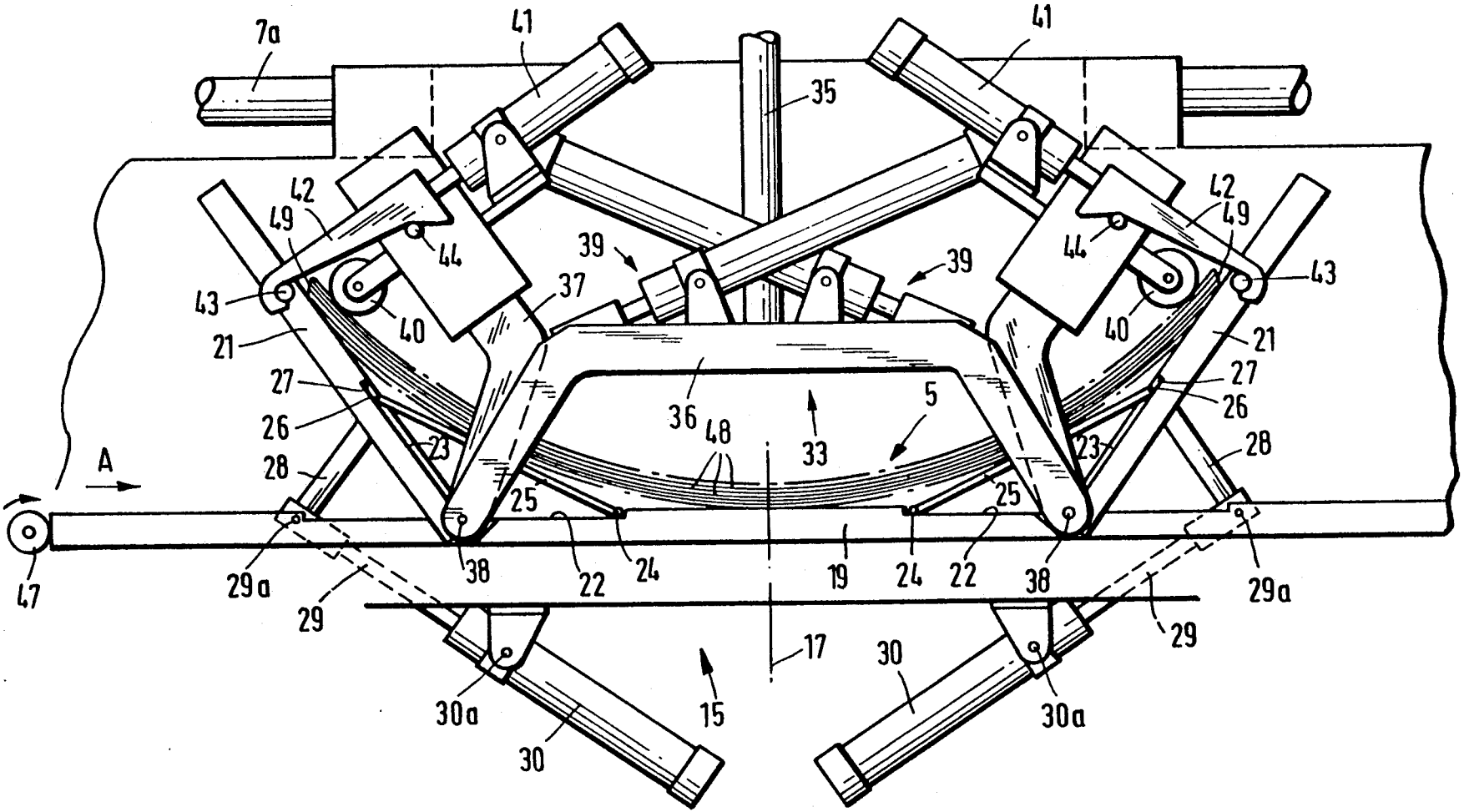
Figure 3:
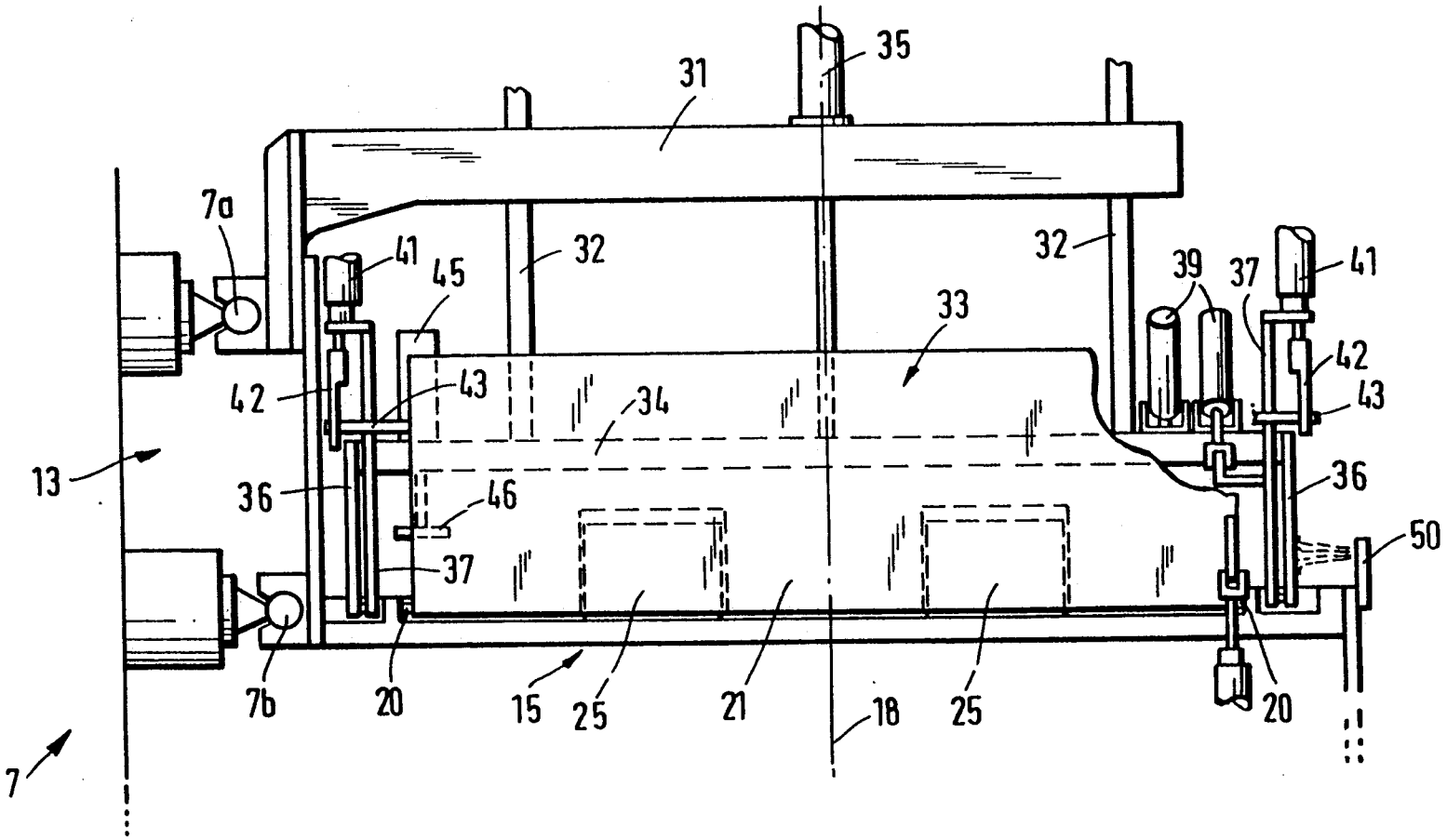

FIG. 1 shows a device according to the invention in a schematic illustration in a side view, FIG. 2 shows a more detailed illustration of the apparatus for the breaking up of the part stack in a side view, FIG. 3 shows a front view of the apparatus for the breaking up according to arrow A in FIG. 2, for graphic reasons shown without pressure element, and FIGS. 4 to 15 show views according to the illustration in FIG. 1 for clarification of the operational sequences which can be achieved with the device according to the invention, shown in a simplified illustration.

FIG. 1 shows a general stack 2 which is arranged on a lifting pallet 1 and which consists, for example, of printed paper sheets. Directly adjacent to the general stack 2, a vibrating station 3 is arranged, with a raisable and lowerable as well as inclinable vibrating table 4 of known construction. The purpose of the device according to the invention, which is subsequently to be described in greater detail, is to remove a part stack from the general stack 2 and to break it up, so that the individual sheets of the part stack 5 can be vibrated accurately at the edges after being deposited on the vibrating table 4. A buffer shelf, for example, or a cutting machine directly, can follow the vibrating station 3.

It can be seen from FIG. 1 that a stationary bearer frame, with upper and lower guides 7a, 7b which run horizontally, is arranged at the side of and partially above the general stack 2 and the vibrating station 3. In the upper guide 7a, a delivery gripper 8 is mounted, which can be brought into contact with the stack side facing away from the vibrating table 3 and which is vertically and horizontally movable in relation to the sheet plane. The delivery gripper 8 has a fixed support plate 9 and a clamping plate 10 which is arranged parallel to the latter and which is adjustable in the direction of the support plate 9 and in the opposite direction by means of adjustment means which are not shown in greater detail. In the bearer frame 7, a blowing nozzle 11 is also mounted, which is located adjacent to the delivery gripper 8 and is likewise horizontally and vertically movable. The air outlet of the blowing nozzle 11 is directed towards that side of the general stack 2 which faces away from the vibrating station. That side of the general stack 2 which faces away is lastly assigned a hook-shaped holding-down device 12 which is likewise mounted horizontally and vertically movably in the bearer frame 7.

In the guides 7a and 7b of the bearer frame 7, as additionally illustrated in FIG. 3, a chassis 13 is mounted horizontally displaceably. The chassis 13 accommodates a horizontally orientated table 15 which forms an essential element of the apparatus for the breaking up of the part stack 5. The chassis 13 is horizontally movable by means of power means which are not illustrated in greater detail and the table 15, which is rigidly connected to the lower area of the chassis 13, can be moved horizontally therewith.

FIGS. 2 and 3 illustrate in detail the mounting and the design of the table 15 which in relation to the planes 17 or 18, which run perpendicularly to the picture planes, is constructed essentially symmetrically. The table 15 has a central table part 19 and two table parts 21 which adjoin directly end faces of the central table part 19, which lie opposite one another in the longitudinal direction of the table 15, and which are pivotable about axes 20. The central table part 19 is in each case, adjacent to the table parts 21 in the area of its support surface, that is to say on top, provided with a recess 22, and the respective table part 21 is likewise provided with a recess 23 on the top and adjacent to the central table part 19. In the transition from the central table part 19 to the recess 22, the respective recess has a bridge segment 25 which is pivotable about an axis 24. The thickness of the table parts 21 and of the bridge segments 25 as well as the dimensions of the recesses 22 and 23 are calculated in such a manner that, with table parts 21 pivoted in and thus bridge segments 25 also pivoted in, the surface of the central table part 19 forms a plane with the upper surfaces of the table parts 21 and bridge segments 25. When the table parts 21 are folded up, the bridge segments 25 slide with their free ends 26 in the recesses 23 until, when the maximum folded out position of the table parts 21, which is pivoted out by an angle of approximately 55°, is reached, they come to lie adjacent to the undercut 27, which forms the recess 23, in the respective table part 21. The illustration of FIG. 2 explains that in the folded up position of the table parts 21 and of the bridge segments 25, an almost uniformly arched curve is determined by these and the central table part 19, in which connection it is of course possible to provide further bridge segments so that, when the table parts 21 are extended, the support contour of the table approximates a constant curve shape.

Downwardly directed pivoting arms 28, at the respective free end of which a piston rod 29 of a pneumatic cylinder 30 mounted in the table 15 engages, are connected rigidly to the table parts 21 adjacent to the pivoting axes 20. At the point 29a, the respective piston rod 29 is connected in an articulated manner to the pivoting arm 28, and at the point 30a the respective cylinder 30 in an articulated manner to the table 15.

FIGS. 2 and 3 explain the mounting of the table 15 in the chassis 13. Above the table 15, the chassis 13 has a horizontal bearer 31 which extends perpendicularly to the longitudinal guides 7a and 7b almost as far as that end of the table 15 lying opposite, above the latter, and on which, by means of vertical guides 32 which are arranged at a distance from one another, a vertically movable portal frame 33 is guided, which extends over almost the entire width of the table 15. The portal frame 33 consists essentially of a frame part 34 which is arranged horizontally and which accommodates the guides 32 and is raisable and lowerable by means of a pneumatic cylinder 35 on the side of the bearer. On each of the two longitudinal sides of the table 15, the portal frame 33 additionally has a bearer frame part 36 which is directed downwards and in the end points of which bearers 37 are pivotably mounted about pivoting axes 38. In the lowered position of the portal frame shown in FIG. 2, the position of the pivoting axes 38 coincides with the position of the bearing axes 20 for the table parts 21. Two bearers 37 are in each case assigned to a table part 21 and are connected by means of a transverse bearer and, between the latter and the frame part 34 of the portal frame 33, a pneumatic cylinder 39, for the pivoting of the bearers 37, engages in each case. Between associated bearers 37, in each case in the area of the bearer ends and parallel to the pivoting axes 38, a pressure roller 40 is mounted, which thus extends over almost the entire width of the table 15. The two pressure rollers 40 are provided with adjustable brake devices which are not shown in greater detail, for example in the form of disk springs, so that they can rotate when a defined torque is exceeded. In the area of each end face of the pressure rollers 40, each bearer 37 is assigned a pivotably mounted pneumatic cylinder 41 which accommodates a relieving hook 42 which can be brought into work connection with a holding pin 43 which is assigned to the respective table part 21. The relieving hook 42 is designed in such a manner that, in the extended state, it is pivoted out of the path of the holding pin 43 by means of contact on a stop pin 44. From the illustration in FIG. 3, it can lastly be seen that in each case two bridge segments 25, which in each case are approximately ¼ as wide as the table 15, are arranged next to one another, and a further pneumatic cylinder 45, which accommodates a holding-down device 46 which is movable in the plane 17, is mounted on one side of the table in the portal frame 33.

FIG. 2 illustrates that the table 15 is provided, on that end face which faces towards the general stack 2, with a conveyor roller 47 for the sliding of the part stack 5 onto the table 15. The mounting of the conveyor roller 47 in the table 15 is not illustrated further, the conveyor roller 47 is drivable in the clockwise direction and extends essentially over the entire width of the table 15.

With reference to FIGS. 4 to 14, the operational sequences, which can be achieved with the device according to the invention, are explained below.

Figure 4:
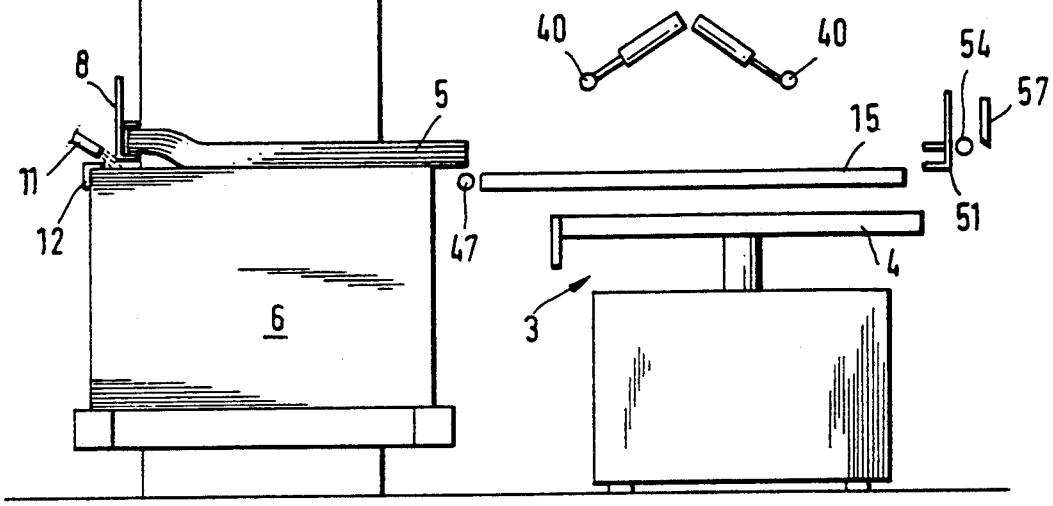
Figure 5:
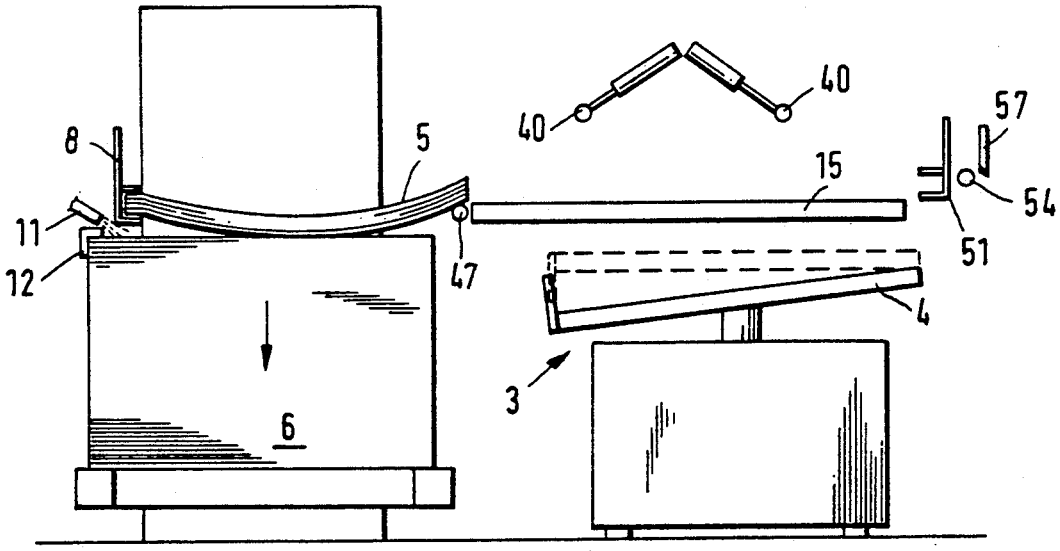
Figure 6:
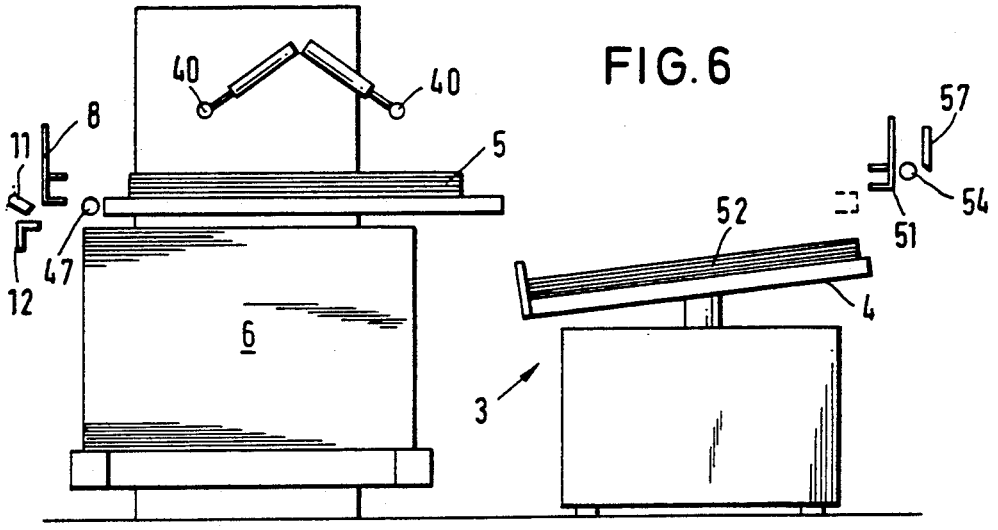

As shown in FIG. 4, the general stack 2 is first raised to such a level that the lowest sheet ply of the part stack 5 to be removed comes to lie slightly higher than the surface of the table 15. Then, by means of a corresponding vertical movement, if necessary overlapped by a horizontal movement, the delivery gripper 8 is brought with its support plate 9 to the level of the lowest sheet ply of the part stack 5 and the clamping plate 10 is moved so far away from the support plate 9 that the two plates 9 and 10 can accommodate the part stack 5 between them. The delivery gripper 8 is then moved into the general stack 2, at the same time separates the part stack 5 from the remaining stack 6 and subsequently the delivery gripper 8 is closed. The holding-down device 12 is moved into the gap between part stack 5 and remaining stack 6 and lowered onto the remaining stack 6, so that the part stack 5 can be displaced by means of the delivery very gripper 8 in the direction of the vibrating table 4 and of the table 15. This process is supported by the blowing nozzle 11 which blows air in between the part stack 5 and the remaining stack 6. During the separation of the part stack 5, the table 15, which is situated slightly below the level of the part stack 5, is moved, with table parts 21 retracted and bearers 37 pivoted up (bearer position according to FIG. 2), in the direction of the general stack 2. As soon as the conveyor roller 47 of the table 15 has arrived below that area of the part stack 5 which projects over the remaining stack 6, the general stack 2 is lowered, so that that end of the part stack 5 which faces towards the conveyor roller 47 rests on the latter (FIG. 5). The table 15 is moved further in between the part stack 5 and the remaining stack 6 until it has passed through the general stack 2 and the part stack 5 rests on the table 15 symmetrically in relation to the plane 17 (FIG. 6). From this position, the delivery gripper 8 moves back to its rest position again, and the holding-down device 12 is released and the blowing nozzle 11 is turned off. While the table 15 is in the area of the remaining stack 6, material in sheet form, which was deposited on the vibrating table 4 subsequent to a preceding cycle, can be vibrated.

Figure 7:
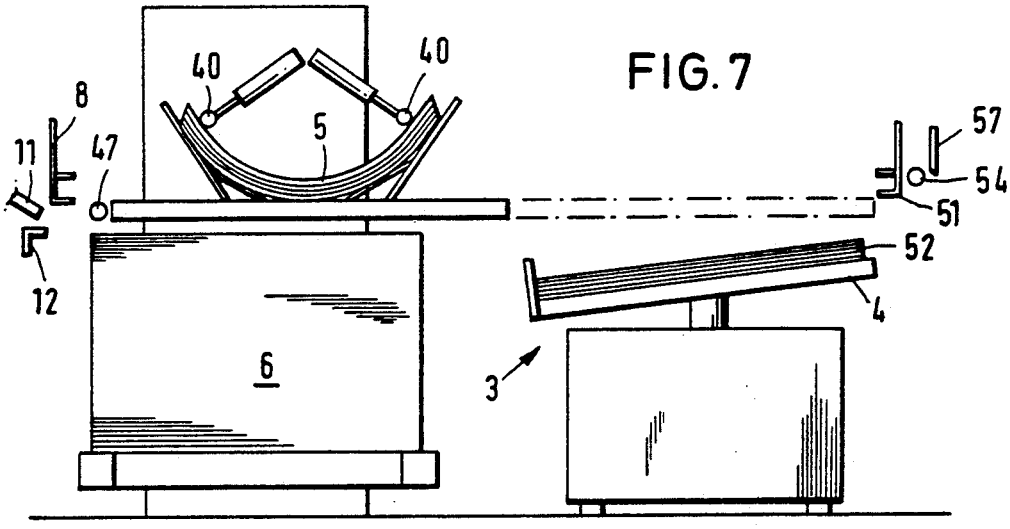

The breaking up of the part stack 5 can already take place in a position of the table 15 above the remaining stack 6, which is illustrated in FIG. 7. The part stack 5, which is resting on the table 15, at first forms a closed block, that is to say the individual sheets 48 cannot be displaced easily over one another, which is a prerequisite for an accurate alignment at the edges of the part stack 5 in the subsequent vibrating table 4. Therefore, after the stack 5 has been placed on the table 15, the pneumatic cylinders 30 are acted upon, which brings about a folding up of the table parts 21 and thus also of the bridge segments 25 into the position also shown in FIG. 2. In this position, as can be seen from the illustration in FIG. 7, the sheet plies, going from the neutral plane 17 towards the edges 49, are displaced to an increasing extent, so that in the area of displacement the block shape is already done away with. When the table parts 21 and bridge segments 25 are folded up, the two pressure rollers 40 are lowered onto the part stack 5 in the area of the two edges 49 by means of action upon the pneumatic cylinders 39. During this, the extended relieving hooks 42 engage behind the holding pins 43; by means of retraction of the relieving hooks 42, the pressure force of the pressure rollers 40 on the part stack can be adjusted to a desired amount, with which the part stack 5 is clamped in its edge areas between the pressure rollers 40 and the table parts 21. If the table parts 21 and thus the bridge segments 25 are then pivoted back by means of action upon the pneumatic cylinders 39, with the simultaneous follow-up of the pressure rollers 40, this brings about a stretching, which increases from the lower to the upper sheet plies, of the individual sheets 48 which thus separate from one another. Additionally, at this moment, by means of a large number of air nozzles 50 (FIG. 3) which are arranged at the side on the table 15, air can be blown between the individual sheets 48. Upon the further lowering of the table parts 21 and of the bridge segments 25 with simultaneous follow-up of the pressure rollers 40, when the upper sheet plies are drawn completely tight, the set braking moment of the pressure rollers 40 is exceeded, so that these roll off outwards on the uppermost sheet 48. As soon as the table parts 21 and the bridge segments 25 are completely folded in, the relieving hooks 42 are extended, whereupon they come out of engagement with the holding pins 43, the bearers 37 can subsequently be pivoted up by means of the pneumatic cylinders 39, so that the part stack 5 could now be advanced to the vibrating station 3. In general, however, the breaking-up process is repeated again, that is to say the table parts 21 are extended again, the pressure roller 40 lowered again, in certain circumstances also after prior rotation of the part stack 5 on the table 15 by 90°.

Figure 8:
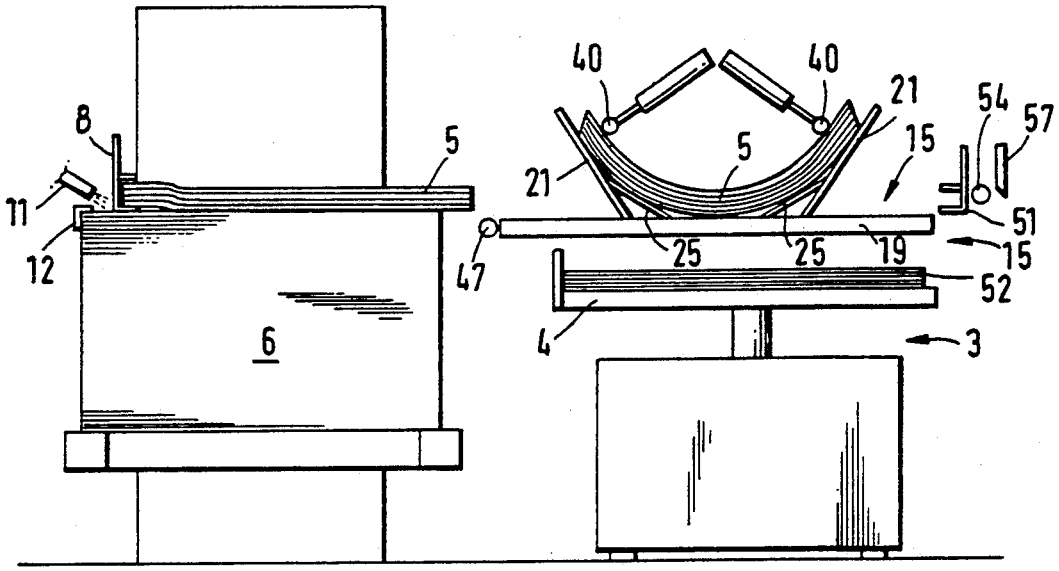

FIG. 8 illustrates that the table 15 can already be moved into its other end position above the vibrating station 3 during the breaking-up process. As soon as this position is reached, the next part stack 5 can already be separated from the remaining stack 6 by means of repeated action of the delivery gripper 8.

Figure 9:
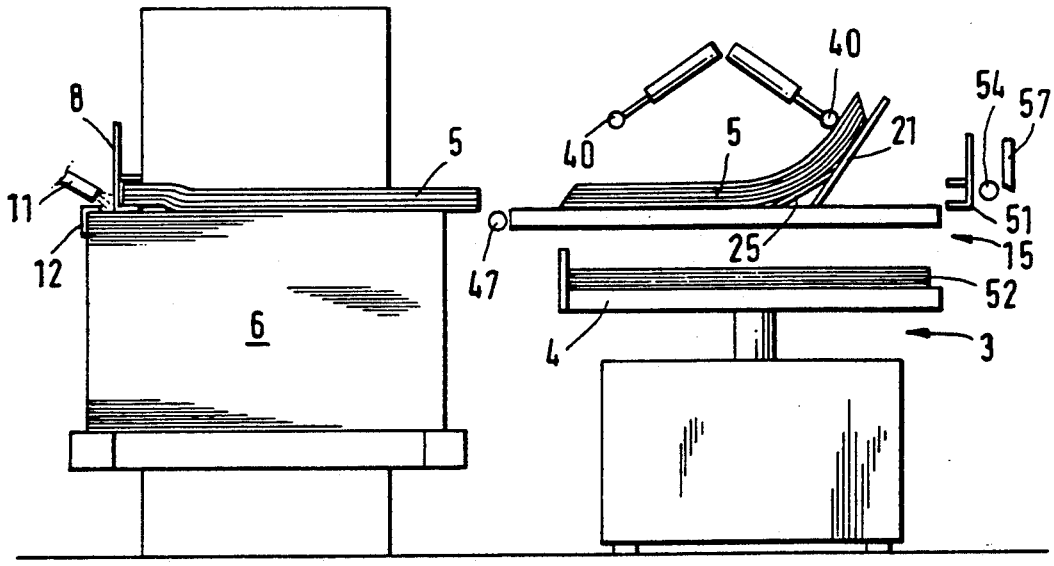
Figure 10:
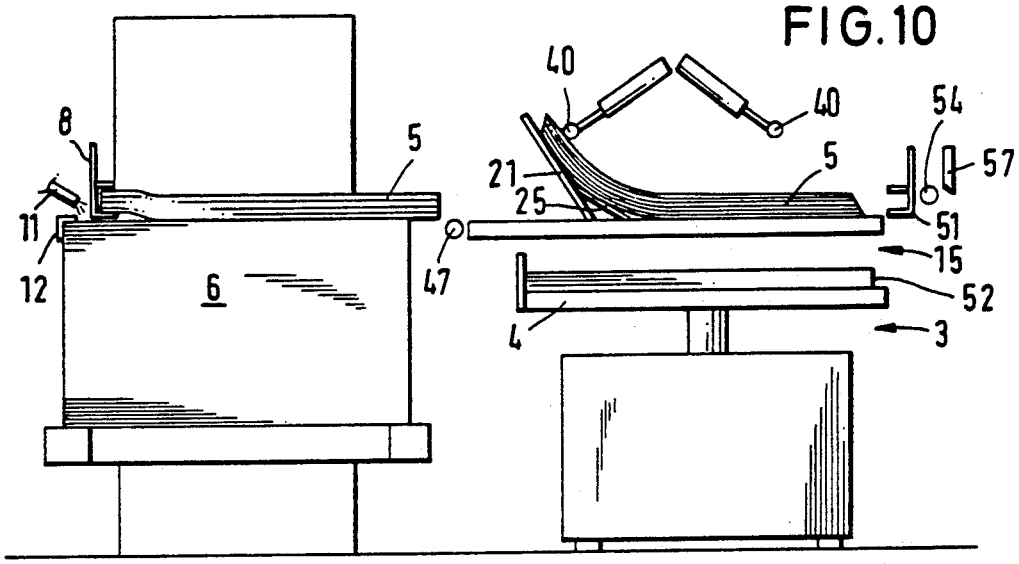

FIGS. 9 and 10 illustrate a procedural section which offers itself in particular subsequent to the breaking-up process described above. Subsequent to the procedural sequence described, the table parts 21 and the bridge segments 25 are thus to be pivoted again into the folded out position shown in FIG. 7, but subsequently only the pressure roller 40 assigned to the right edge 49 (FIG. 9) or the pressure roller 40 assigned to the left edge 49 (FIG. 10) is lowered onto the part stack 5. When the table parts 21 and the bridge segments 25 are folded in, in which connection the table parts 21 do not necessarily have to be lowered synchronously, the pressure roller 40 assigned to the respective edge 49 fixes this stack area, so that the part stack 5, when the table parts 21 and bridge segments 25 are retracted, is in the form of a parallelogram. Such a breaking up is expedient if the part stack 5 is subsequently to be vibrated abutting on the left (FIG. 9) or abutting on the right (FIG. 10) in the vibrating table 4.

Figure 11:
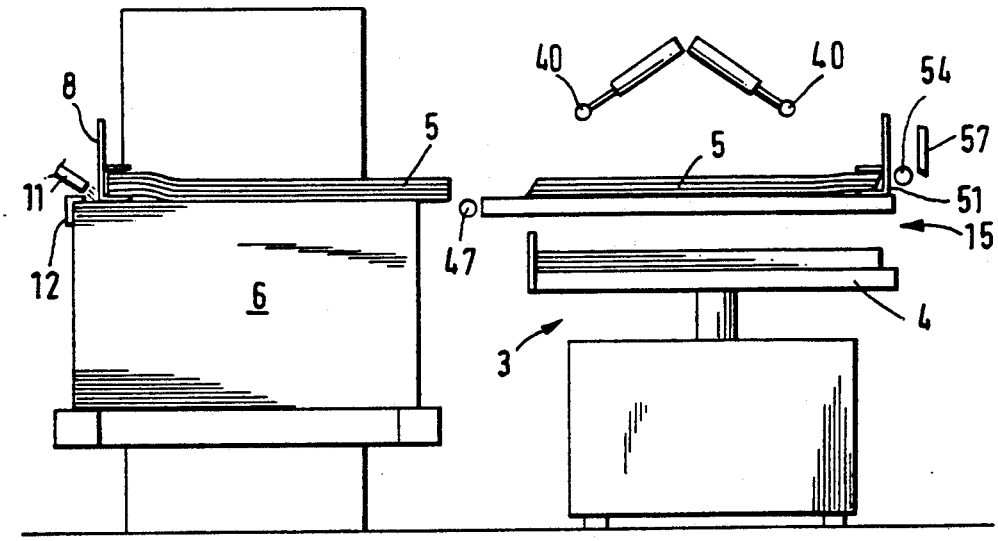
Figure 12:
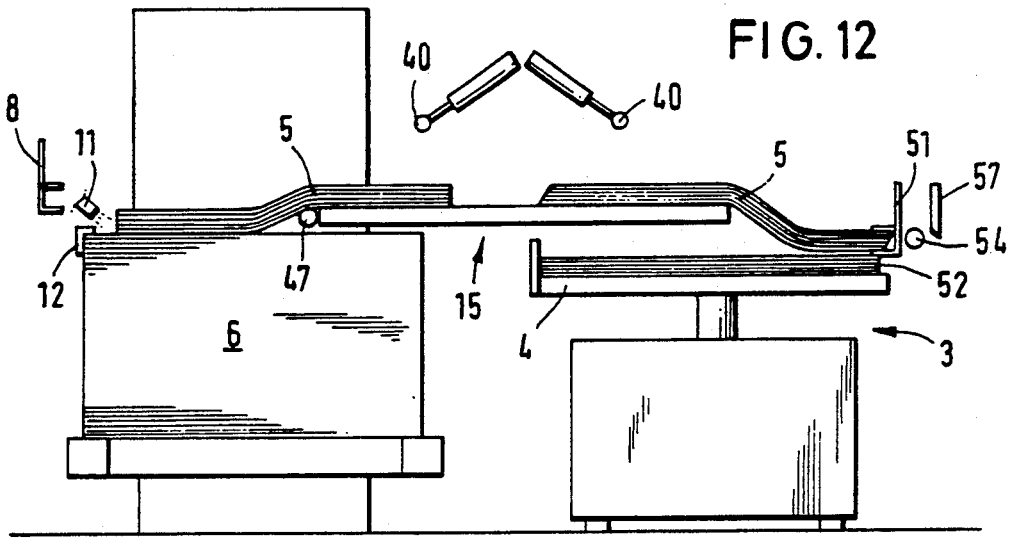

FIG. 11 shows the broken up part stack 5 in relation to abutting on the left, with table parts 21 folded in. A distributing gripper 51, which can be moved in a correspodning manner to the delivery gripper 8, is moved into a position for gripping the part stack 5 on the right. The table 15 is then moved in the direction of the general stack 2 which has previously been lowered so far that the conveyor roller 47 of the table 15 can move under the next projecting part stack 5. Upon the further movement of the table 15 into the gap formed between the part stack 5 and the remaining stack 6, the part stack 5 which has already been broken up is, by means of an essentially vertical movement of the distributing gripper 51, put down on the previously vibrated sheet plies which are accommodated by the vibrating table 4 (FIG. 12). In relation to the take-over of the part stack 5 from the general stack 2, the procedural sections described in relation to FIGS. 5 to 11 follow.

Figure 13:
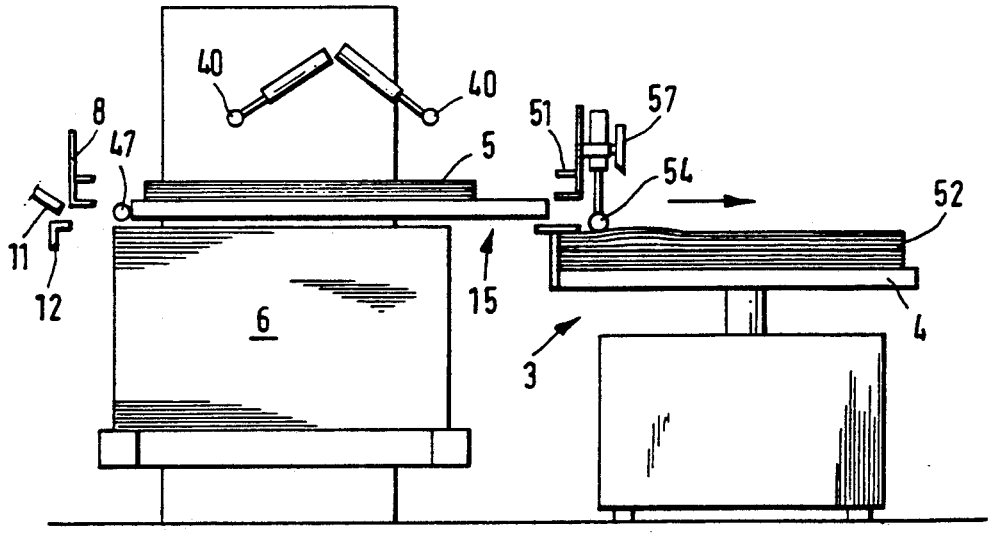
Figure 14:
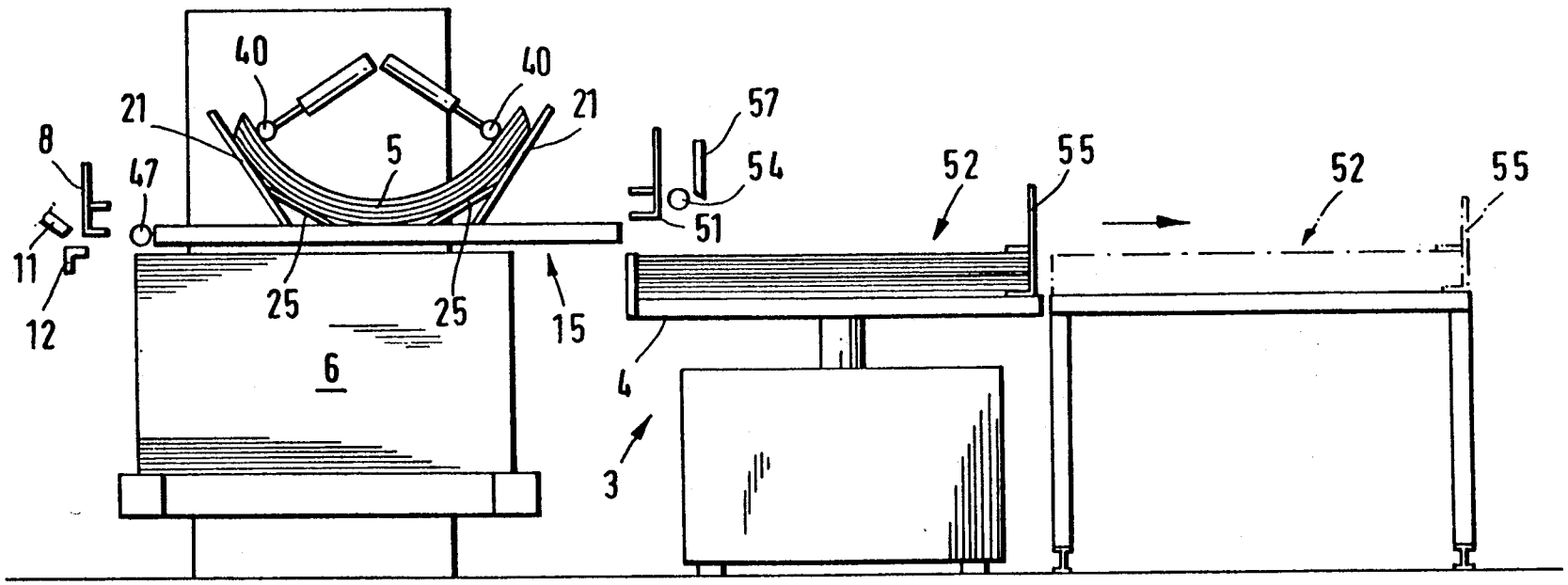
Figure 15:
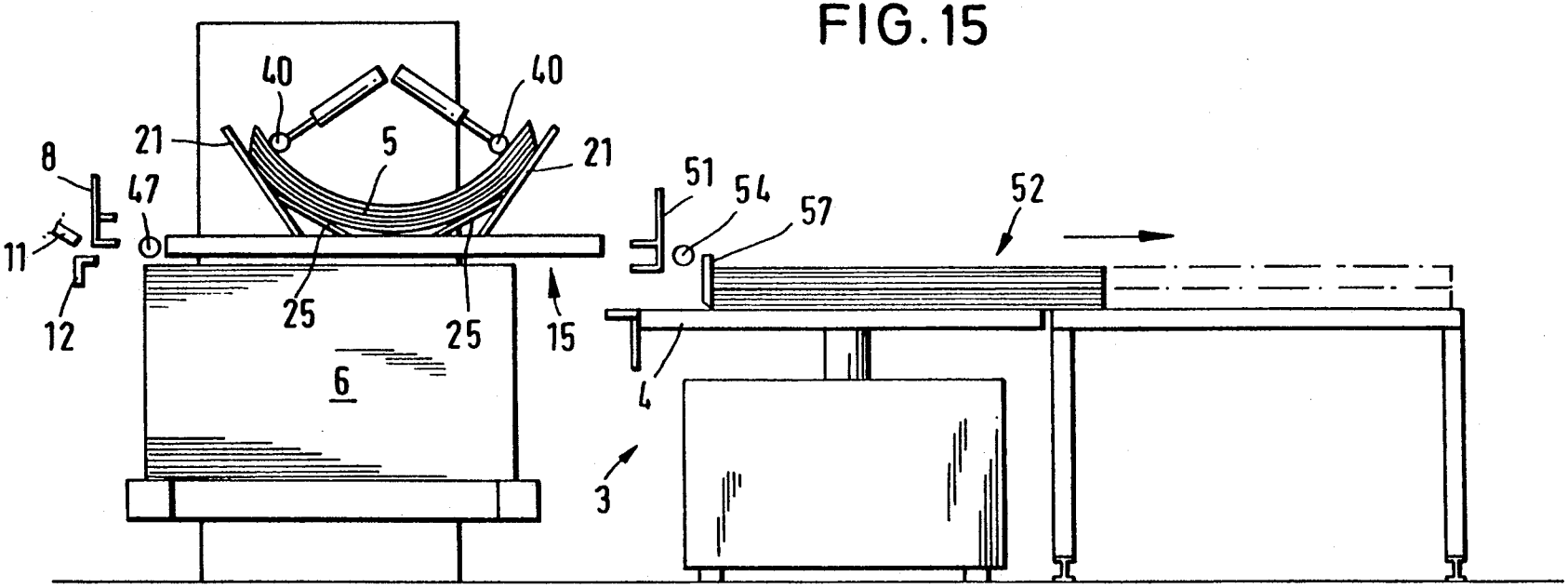

FIG. 13 illustrates that, during the take-over of the next part stack 5 onto the table 15 and subsequent to the vibrating of the part stack 5 last put down on the vibrating table 4, the vibrated general stack 52 is gripped in a clamped manner on one side by means of a holding-down device 53 and subsequently an air-expressing roller 54 is moved over the vibrated general stack 52. While the part stack 5 last removed from the general stack 2 is broken up, the deaerated general stack 52 can be advanced to a buffer shelf 56 or a cutting machine, for example, by means of a gripper 55 (FIG. 14) or a slider 57 (FIG. 15).

The device described is not restricted to the handling of paper sheets, but generally relates to material in sheet form. In this connection, in particular material in sheet form made of paper, cardboard, plastic film or the like in printed or unprinted form is envisaged.

I claim:

1. A device for transfer of a part stack of material in sheet form from a general stack to a further processing station having an apparatus for the transfer of said part stack to an apparatus for breaking up of said part stack and an apparatus for the transfer of the broken up part stack to the further processing station, characterized in that the apparatus for the breaking up of the part stack comprises table means for supporting said part stack in a horizontal plane and is mounted in a movable chassis, said table means having in the area of at least one end, a table part which can be folded up out of said horizontal table plane and a pressure element mounted in the chassis above said table part to contact a portion of said part stack folded up out of said horizontal plane, said table means being movable to a first end position between said part stack and a remaining stack, and to a second position above said further processing station.

2. The device of claim 1 wherein said table means comprises table parts at both ends comprising a pair of first and second pivoting table parts.

3. The device of claim 2 wherein said first and second pivoting table parts comprise a primary folding table and a secondary bridging table overlapping at least a portion of said primary folding table, said table parts pivoting through spaced parallel axes.

4. The device of claim 3 wherein said pressure element comprises rotatable roller means.

5. The device of claim 3 wherein said pressure element comprises roller means with adjustable braking means.

6. The device of claim 1 wherein the chassis is mounted on rail means for horizontal movement.

7. The device of claim 3 wherein said pressure element comprises a vertically movable central frame member positioned above aid table parts, arm extension pivotally mounted to said central frame member with said pressure element being rotatably mounted on said arm extensions.

8. The device of claim 7 wherein the end of said table means in proximity to said general stack includes roller means for transferring a part stack segment onto said table.

9. The device of claim 8 including gripper means for transferring a part stack segment from said remaining stack to said table means and distribution gripper means for transferring separated plies to said further processing station.

10. The device of claim 9 wherein said further processing station comprises means for vibrating separated plies.

11. The device of claim 9 wherein said gripper means are horizontally movable in the direction of said chassis and also vertically movable.

12. The device of claim 11 wherein said gripper means includes means for blowing air between sheet plies for enhancing separation.

* * * * *